United States Patent [19]

Alexander

[11] Patent Number: 4,773,391

[45] Date of Patent: Sep. 27, 1988

[54] FLAME PROTECTOR FOR HOT WATER HEATERS IN RECREATIONAL VEHICLES

[76] Inventor: Ralph C. Alexander, 721 Hansen Ave., Idaho Falls, Id. 83402

[21] Appl. No.: 141,548

[22] Filed: Jan. 7, 1988

[51] Int. Cl.[4] ..... F24H 1/00

[52] U.S. Cl. ..... 126/361; 431/146; 431/251; 98/34.6; 237/36

[58] Field of Search ..... 431/310, 251, 146; 126/307 A, 112, 347, 344, 350 R, 361; 98/34.6, 121; 237/35, 36

[56] References Cited

U.S. PATENT DOCUMENTS 2,679,201 5/1954 Scharmen .
3,618,507 11/1971 Rakocy .
3,785,699 1/1974 Molaskey et al. .
3,994,280 11/1976 Winters et al. ..... 126/307 A
4,347,781 9/1982 Hassell .
4,509,681 4/1985 Kogut ..... 98/34.6

*Primary Examiner*—Henry Bennett
*Attorney, Agent, or Firm*—Henderson & Sturm

[57] ABSTRACT

An attachment for a recreational vehicle of a type having a gas-fired hot water heater inside and having an exterior skin therearound. The hot water heater includes a burner and a vent for permitting outside air to communicate with the burner of the hot water heater. A rigid wind guard is operatively and removably attached to one side of the vent on the outside of the recreational vehicle for preventing wind from blowing out the burner when such burner is operating.

6 Claims, 2 Drawing Sheets

FLAME PROTECTOR FOR HOT WATER HEATERS IN RECREATIONAL VEHICLES

TECHNICAL FIELD

The present invention relates generally to an apparatus for attachment to a recreational vehicle for preventing the burner of a hot water heater from being blown out by the wind and more particularly to such an apparatus which is reversible in case the wind is coming from one direction or another.

BACKGROUND ART

Recreational vehicles such as travel trailers, campers, 5th-wheel travel trailers, or self-propelled units, typically have many of the conveniences of home. For example, they typically have a hot water heater for use in a kitchen or shower in such recreational vehicle.

Normally such hot water heaters have an access door attached to the outer skin of the recreational vehicle which is removable and which is vented so as to provide access to the burner for lighting a pilot light or adjusting the burner and furthermore being vented to introduce a needed amount of air to support combustion. Furthermore, such a vent will channel any gas leakage around the burner out of the recreational vehicle rather than creating a dangerous situation inside.

A problem with the aforementioned vented door for hot water heaters of recreational vehicles is that if a strong wind blows in such vent, sometimes the burner or the pilot light or both are extinguished, thereby requiring the user to go outside and light it again, which incidentally does not ensure that it will stay lit. This problem can be a major inconvenience to recreational vehicles users.

DISCLOSURE OF THE INVENTION

The present invention relates to an attachment for a recreational vehicle of a type having a gas-fired hot water heater inside and having an exterior skin therearound. The hot water heater includes a burner and a vent for permitting outside air to communicate with the burner of the hot water heater. A rigid wind guard is operatively and removably attached to one side of the vent on the outside of the recreational vehicle for preventing wind from blowing out the burner when such burner is operating.

An object of the present invention is to provide a flame protector for hot water heaters on recreational vehicles.

Another object of the present invention is to provide a flame protector of the aforementioned type which is reversible so that it can protect the burner from being blown out regardless of which direction the wind blows from.

Another object of the present invention is to provide a flame protector of the aforementioned type which does not block the flow of air to the hot water heater nor will it block or trap any gas since it is open on three sides.

A still further object of the present invention is to provide a flame protector which will not cause a fire hazard.

A still further object of the present invention is to provide a flame protector of the aforementioned type which is economical to produce and dependable in its use.

Other objects, advantages, and novel features of the present invention will become apparent from the following detailed description of the invention when considered in conjunction with the accompanying drawings.

BEST MODE FOR CARRYING OUT THE INVENTION

Figure 1:
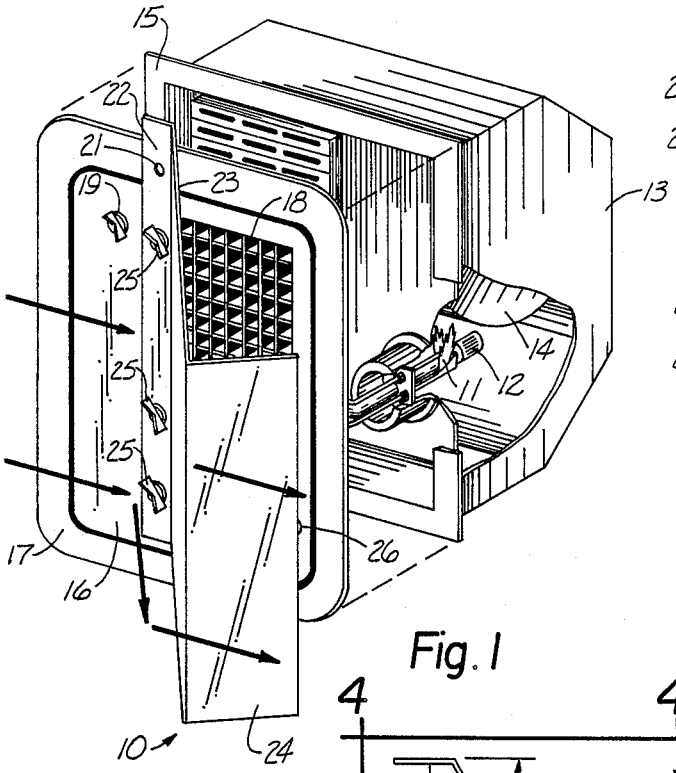
FIG. 1 is an exploded perspective and partially broken away view of a portion of a hot water heater installed in a recreational vehicle and showing a removable access door which has a vent thereon and such door having a preferred embodiment of the flame protector of the present invention attached thereto.
Figure 5:
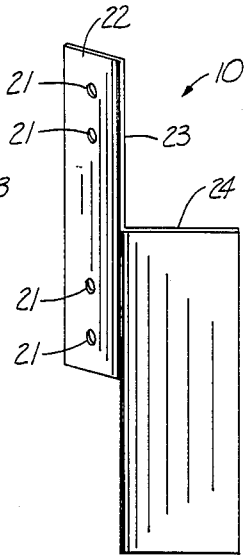
FIG. 5 is a perspective view of the flame protector of the present invention.
Figure 2:
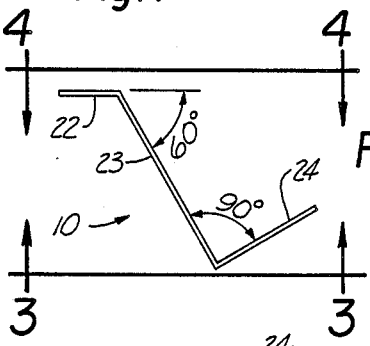
FIG. 2 is a top view of the flame protector of the present invention.
Figure 3:
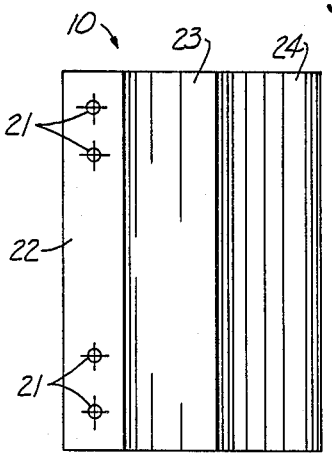
FIG. 3 is a front view taken along line 3—3 of FIG. 2.
Figure 4:
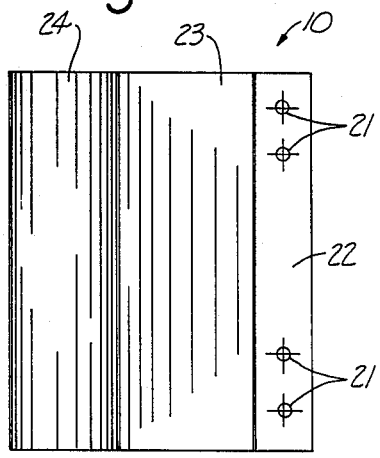
FIG. 4 is a rear view taken along line 4—4 of Fig. 2.

Referring now to the drawings wherein like reference numerals designate identical or corresponding parts throughout the several views, FIG. 1 shows a flame protector apparatus (10) which operates as a wind guard to prevent wind from blowing out a pilot light (11) or burner (12) of a recreational vehicle hot water heater (13). The hot water heater (13) has a water tank (14) and a front opening (15) which can be closed by a door (16) removably attached to a door frame (17). The door (16) includes a vent screen (18) for allowing air to enter and provide oxygen for the burners (11) and (12) and also to prevent gas from being trapped within the recreational vehicle.

The door (16) is removable by a wing nut and bolt assembly (19).

A plurality of holes (21) are drilled in a first rectangular section (22) of the flame protector (10). The flame protector (10) is preferably formed of one piece of sheet metal formed into three planer rectangular sections (22), (23) and (24).

Figure 6:
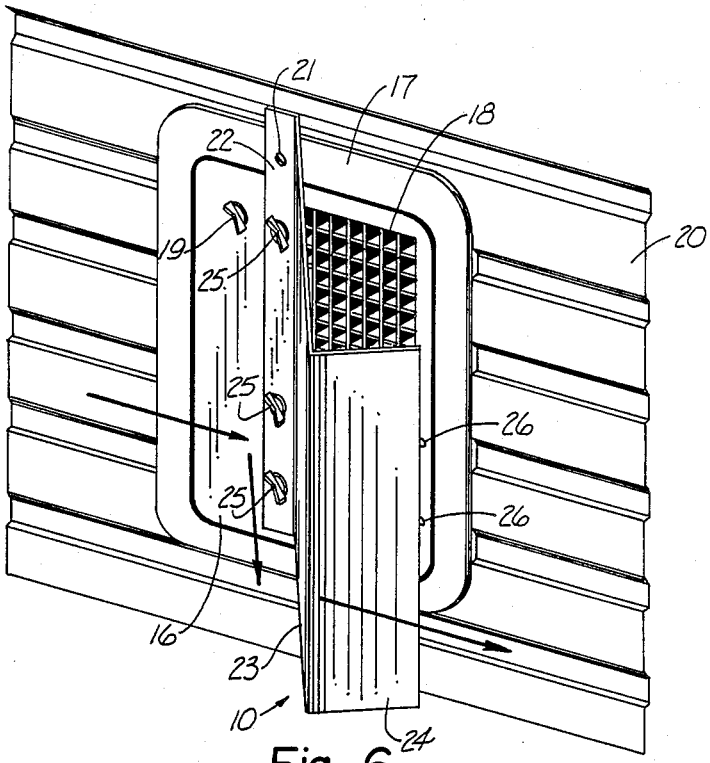
FIG. 6 is a partial perspective view of the present invention installed in those situations when the wind is coming predominantly from left to right as shown in FIG. 6.
Figure 7:
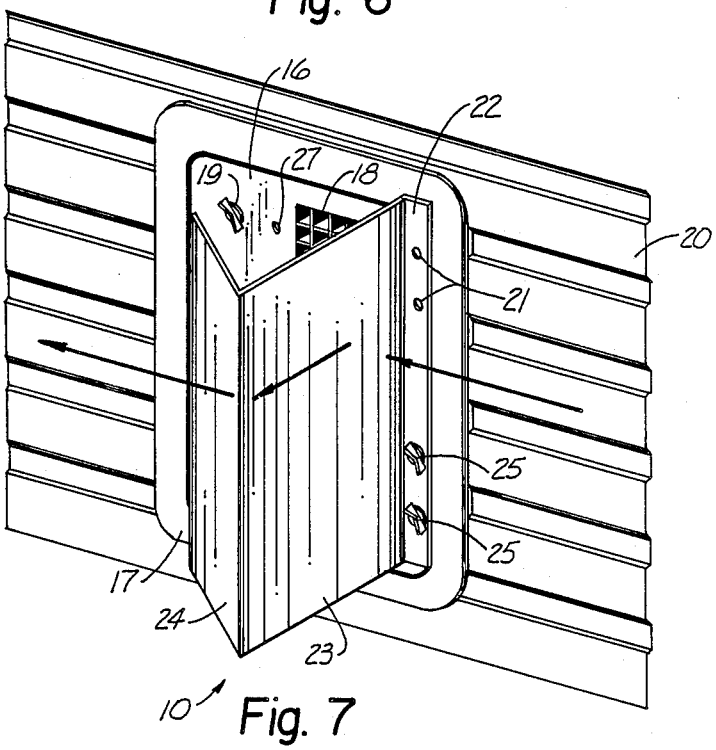
FIG. 7 shows the flame protector of the present invention reversed for those situations when the wind is coming predominately from right to left as shown in FIG. 7.

Wing nut and bolt assemblies (25) are utilized to connect the flame protector (10) to the door (16) through corresponding openings (26) and (27) in the door (16). The flame protector can be installed in the manner shown in FIG. 6 wherein if the wind is coming predominately from left to right, then the arrangement shown in FIG. 6 would be appropriate to prevent the wind from blowing straight in through the vent (18) and blowing out the burners (11) or (12). Conversely, if the wind is blowing predominately from right to left, then the flame protector (10) would be reversed to the position shown in FIG. 7 and fasteners (25) would be used to extend through openings (26) in the door (16) instead of through openings (27) in the door as shown in FIG. 7.

It will be appreciated by those skilled in this art that this reversible unit (10) does not block any flow of air to the hot water heater nor will it block or trap any gas, since it is open on three sides. It stays as cool as the door (16) it is attached to, thereby not causing a fire hazard. It is easy to install or remove after the holes (26) or (27) have been drilled into the hot water heater door (16). The use of wing nuts (25) makes the attaching or detaching process very easy by hand with no tools being required. All recreational vehicles need such a flame protector for its hot water heater door, since this flame is the first to be blown out with a very small amount of wind.

Accordingly, it will be appreciated that the preferred embodiment disclosed herein does indeed accomplish the aforementioned objects. Obviously, many modifications and variations of the present invention are possible in light of the above teachings. It is therefore to be understood that, within the scope of the appended claims, the invention may be practiced otherwise than as specifically described.

I claim:

1. In a recreational vehicle of a type having a gas-fired hot water heater inside, an exterior skin therearound, said hot water heater including a burner, and a vent means for permitting outside air to communicate with the burner of said hot water heater, the improvement comprising:

a rigid wind guard means operatively and removably attached to one side of said vent means outside of said recreational vehicle for preventing wind from blowing out said burner when said burner is operating.

2. The improvement of claim 1 including means for permitting said guard means to be moved to the other side of said vent means when the wind is blowing in a substantially opposite direction.

3. The improvement of claim 2 wherein said guard means comprises:

a first rectangular planer section;

a second rectangular planer section connected along one side to one side of said first rectangular planer section; and a third rectangular planer section, one side of said third rectangular planer section being connected to the other side of said second rectangular planer section.

4. The improvement of claim 3 wherein said third rectangular planer section is disposed substantially perpendicular to said second rectangular planer section and the angle between the first and second rectangular planer sections is substantially greater than 90 degrees.

5. The improvement of claim 4 including a plurality of openings in said first rectangular planer section.

6. The improvement of claim 5 including fastening means for selectively extending through selected ones of said openings and through openings to one side or the other of said vent means on said recreational vehicle for selectively and adjustably attaching said guard means to one side or the other of said vent means

* * * * *